US006600386B1

(12) United States Patent
Löbl et al.

(10) Patent No.: US 6,600,386 B1
(45) Date of Patent: Jul. 29, 2003

(54) THIN-FILM BROADBAND COUPLER

(75) Inventors: Hans-Peter Löbl, Monschau-Imgenbroich (DE); Rainer Kiewitt, Roetgen (DE); Mareike Klee, Hückelhoven (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/540,866

(22) Filed: Mar. 31, 2000

(30) Foreign Application Priority Data

Apr. 3, 1999 (DE) ..... 199 15 246

(51) Int. Cl.[7] ..... H01P 3/08
(52) U.S. Cl. ..... 333/116; 333/136
(58) Field of Search ..... 333/116, 136, 333/238, 161

(56) References Cited

U.S. PATENT DOCUMENTS 4,648,087 A * 3/1987 Scranton et al. ..... 360/234.7
4,999,593 A * 3/1991 Anderson ..... 333/112
5,432,487 A * 7/1995 Dydyk ..... 333/161
5,659,274 A * 8/1997 Takahashi et al. ..... 333/204

FOREIGN PATENT DOCUMENTS

EP 0298434 A3 1/1989 ..... H01P/5/18

OTHER PUBLICATIONS

"A 900MHz 90 Degrees Hybrid For QPSK Modulator", by S. Arai et al., IEEE MIT–S International Microwave Symposium Digest, vol. II, 1991, pp. 857–860.

* cited by examiner

*Primary Examiner*—Robert Pascal
*Assistant Examiner*—Joseph Chang
(74) *Attorney, Agent, or Firm*—Steven R. Biren

(57) ABSTRACT

A thin-film coupler with a carrier substrate (1) and two strip lines disposed thereon, of which one represents the main coupler loop (2) and one the auxiliary coupler loop (3). The use of inexpensive carrier substrate materials and a compact construction are made possible through an integration of a strip line, a coil, or an LC combination into the auxiliary coupler loop (3). The integration of these components (4) achieves a phase shift in the frequency of the signal coupled out so that a broadband coupler is obtained which exhibits an identical coupling at at least two frequencies.

15 Claims, 6 Drawing Sheets

THIN-FILM BROADBAND COUPLER

BACKGROUND OF THE INVENTION

This invention relates to a thin-film coupler with a carrier substrate and two strip lines disposed thereon, of which one is the main coupler loop and the other the auxiliary coupler loop.

Couplers are inter alia high-frequency components for mobile telephones or base stations which render possible the coupling of HF signals between the output of a power amplifier and an antenna. The signal coupled out is used for controlling the output power of the amplifier. Such a coupler comprises, for example, two coupler loops of which one loop is the main loop which is to transmit the transmission signal with the lowest possible losses. The second loop, the auxiliary loop, couples out a signal which is small compared with the transmission signal.

Such couplers are known in various embodiments. One of these is a coupler in the ceramic multilayer technology. The electrode structures are printed on ceramic foils, the foils are stacked, and subsequently sintered so as to form components in the case of these ceramic couplers. The disadvantage in this printing method is the coarse-grained morphology of the electrodes, which leads to a higher electrical resistance.

Furthermore, there are embodiments in the microstrip technology. A thin-film coupler is described in 1991 IEEE MTT-S International Microwave Symposium Digest, vol. II, 857–860 which comprises two strip lines forming coupler loops. The two coupler loops are provided on a dielectric substrate with a high dielectric constant K. A metal layer is present on the rear side of the ceramic substrate so as to form a grounding plane. Six end contacts are fastened to the component, two of these being in contact with a coupler loop each time, and two being connected to the grounding plane. The use of a dielectric substrate with a dielectric constant has the advantage that the components can be realized in a compact construction. A major disadvantage is, however, that these substrates are substantially more expensive than, for example, glass or $Al_2O_3$. If a compact coupler (coupler length $<<\lambda/4$) is realized on such inexpensive substrates, the couplers will show a frequency shift of the coupler signal of approximately 6 dB/frequency octave.

SUMMARY OF THE INVENTION

The invention has for its object to provide an inexpensive compact coupler which exhibits the same coupling at several frequencies, i.e. over a broad frequency range.

This object is achieved by means of a thin-film coupler with a carrier substrate and two strip lines disposed thereon, of which one is the main coupler loop and the other the auxiliary coupler loop, wherein a component is integrated into the auxiliary coupler loop, which component achieves a phase shift of the frequency of the signal coupled out.

Usually, couplers show a strong frequency dependence in their coupling. The incorporation of a component in the auxiliary coupler loop which achieves a phase shift of the frequency of the signal coupled out makes for a greater band width of the coupling.

In a preferred embodiment of the thin-film coupler, the component achieving a phase shift of the frequency of the signal coupled out and integrated into the auxiliary coupler loop is a strip line.

The incorporation of a strip line in the auxiliary coupler loop represents the simplest embodiment of the thin-film coupler, since the strip line can be integrated directly into the auxiliary coupler loop and no additional process step is necessary in the manufacture.

In another preferred embodiment of the thin-film coupler, the component achieving a phase shift in the frequency of the signal coupled out and integrated into the auxiliary coupler loop is a coil.

A coil may be integrated into the auxiliary coupler loop in a simple manner in that it is also implemented in the strip line technology and is accordingly applied in the same process step as the rest of the auxiliary coupler loop. Alternatively, however, a coil may be provided by means of other thin-film techniques and subsequently be electrically contacted with the auxiliary coupler loop.

In a particularly advantageous embodiment of the thin-film coupler, the component achieving a phase shift in the frequency of the signal coupled out and integrated into the auxiliary coupler loop is formed by a coil and a capacitor connected in series or in parallel.

The incorporation of an LC combination results in a particularly strong enlargement of the band width of the coupler.

Preferably, the material used for the carrier substrate is a ceramic material, a ceramic material with a planarizing layer of glass, a glass-ceramic material, or a glass material. A carrier substrate made from these materials can be inexpensively manufactured and the process cost for the relevant components can be kept low.

It is furthermore preferred that each end of a coupler loop is electrically connected to a current supply contact.

Each component can be electrically connected to further components of a circuit by its current supply contacts. Depending on the type of application or type of component mounting, an electroplated SMD end contact or a bump end contact or a contact surface may be used as the current supply contact. The use of SMD end contacts or bump end contacts renders possible the manufacture of discrete components.

It is also preferred that at least one protective layer of an inorganic material and/or an organic material is provided over the thin-film coupler.

The protective layer protects the component against mechanical loads and corrosion caused by moisture.

It is advantageous that a metal layer is provided on the lower side of the carrier substrate.

This metal layer serves as a grounding plane.

In this advantageous embodiment of the thin-film coupler, it is preferred that the metal layer is connected to at least one further current supply contact.

The invention will be explained in more detail below with reference to six Figures and three embodiments. In the Figures:

DESCRIPTION OF THE PREFERRED EMBODIMENTS

Figure 1:
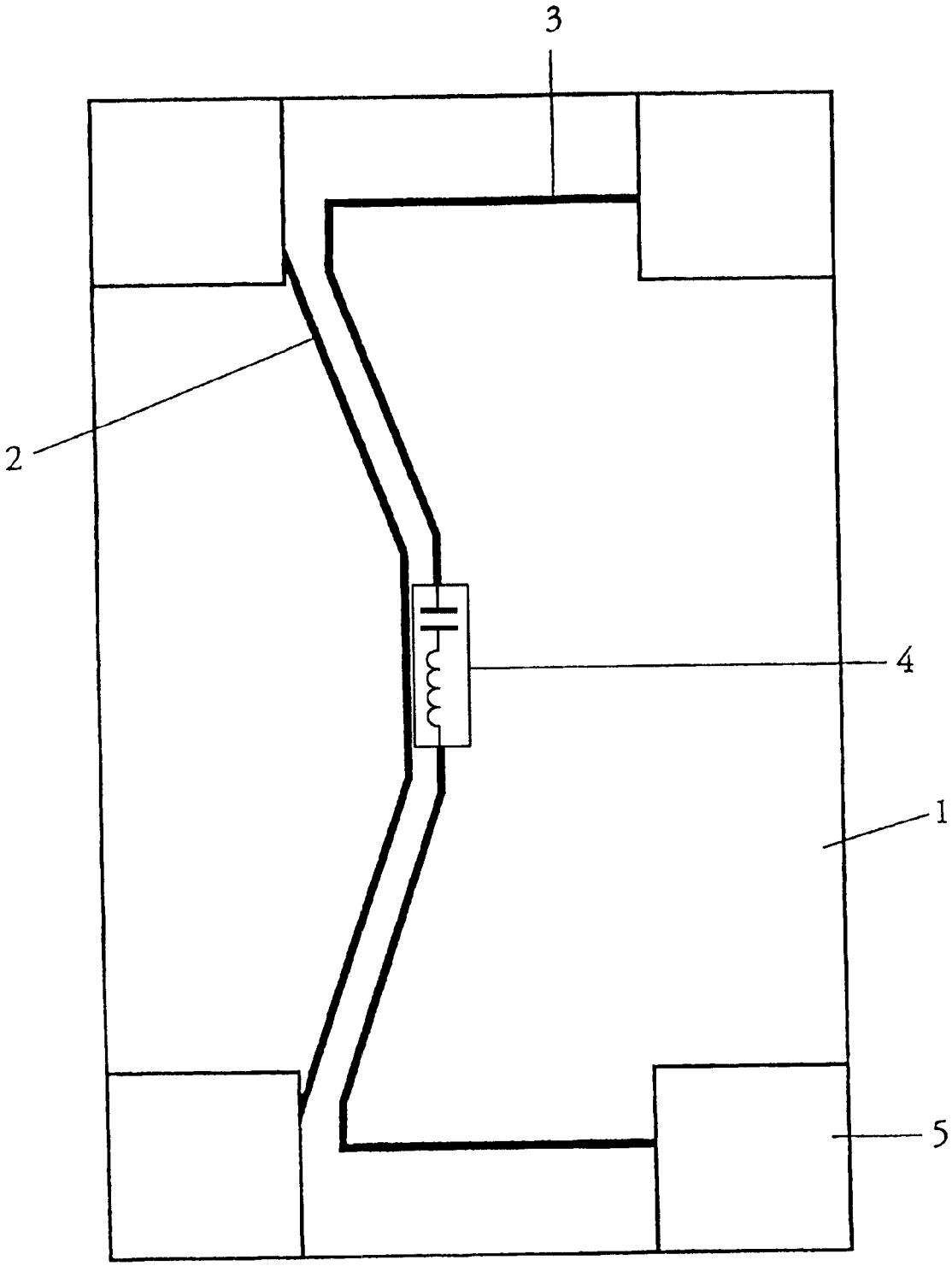
FIG. 1 diagrammatically shows the construction of a thin-film coupler in which a phase-shifting component is integrated into the auxiliary coupler loop.

In FIG. 1, a thin-film coupler comprises a carrier substrate 1 which comprises, for example, a ceramic material, a ceramic material with a glass planarizing layer, a glass-ceramic material, or a glass material. A main coupler loop 2 and an auxiliary coupler loop 3 are provided on the carrier substrate 1. Both loops may be constructed, for example, in the strip line technology and comprise Cu, Al, Ag, Au, or a combination of these metals. A component 4 which shifts the frequency of the coupled-out signal is integrated into the auxiliary coupler loop 3. In addition, four current supply contacts 5 are fastened to the thin-film coupler, which contacts are interconnected two by two-via the two coupler loops, respectively. An electroplated SMD end contact of Cr/Cu, Ni/Sn or Cr/Cu, Cu/Ni/Sn or Cr/Ni, Pb/Sn, or a bump end contact, or a contact surface may be used, for example, for the current supply contact 5.

In the simplest case, the phase-shifting component 4 may be implemented in the strip line technology, as the coupler loops, and be directly integrated into the auxiliary coupler loop 3. The phase-shifting component 4 may alternatively be manufactured, for example, by means of thin-film techniques and subsequently be electrically contacted with the auxiliary coupler loop 3.

Figure 2:
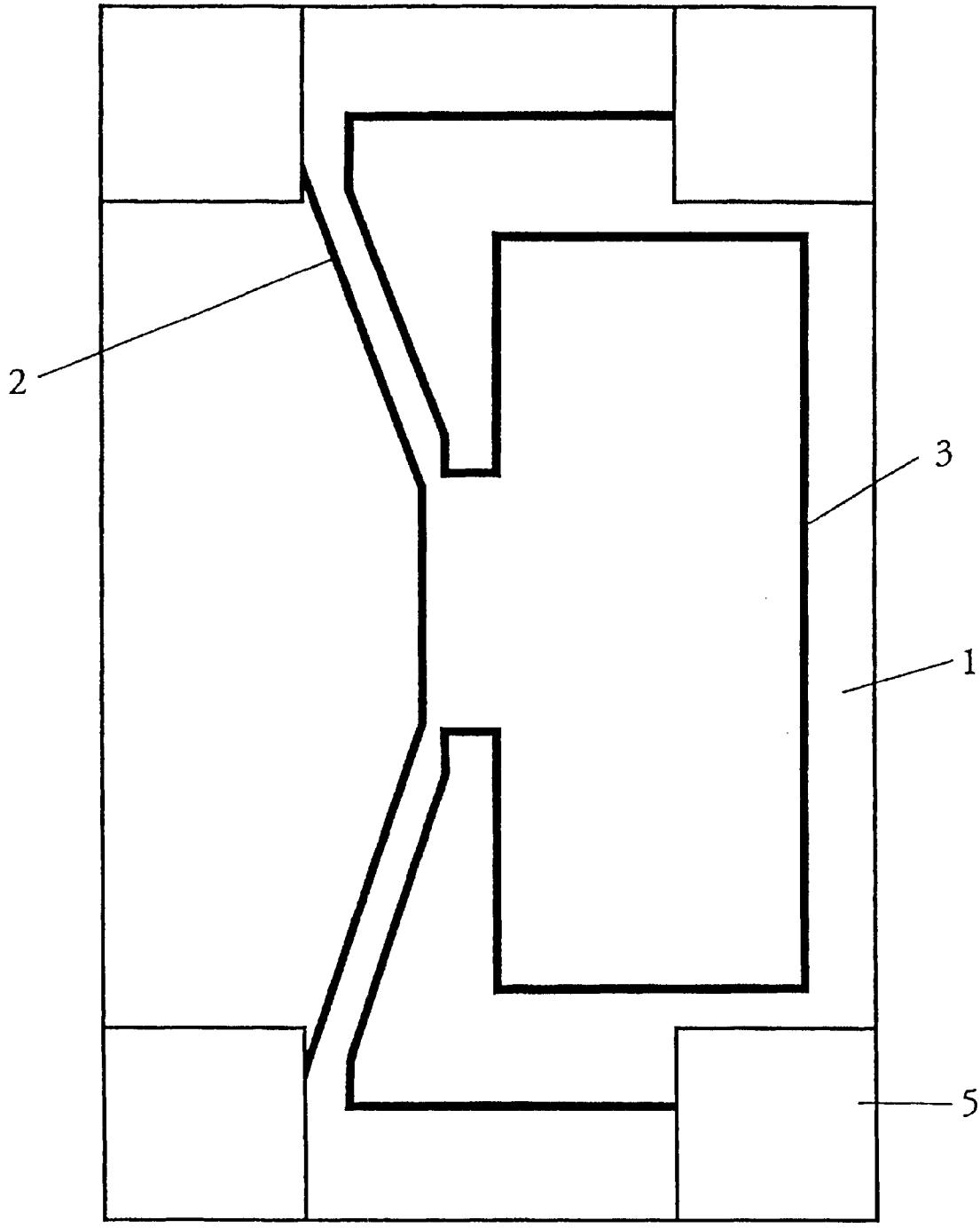
FIG. 2 is an elevation of a thin-film coupler in which a strip line is integrated into the auxiliary coupler loop.

In FIG. 2, the auxiliary coupler loop 3 is so constructed that it achieves a phase shift on account of its length.

Figure 3:
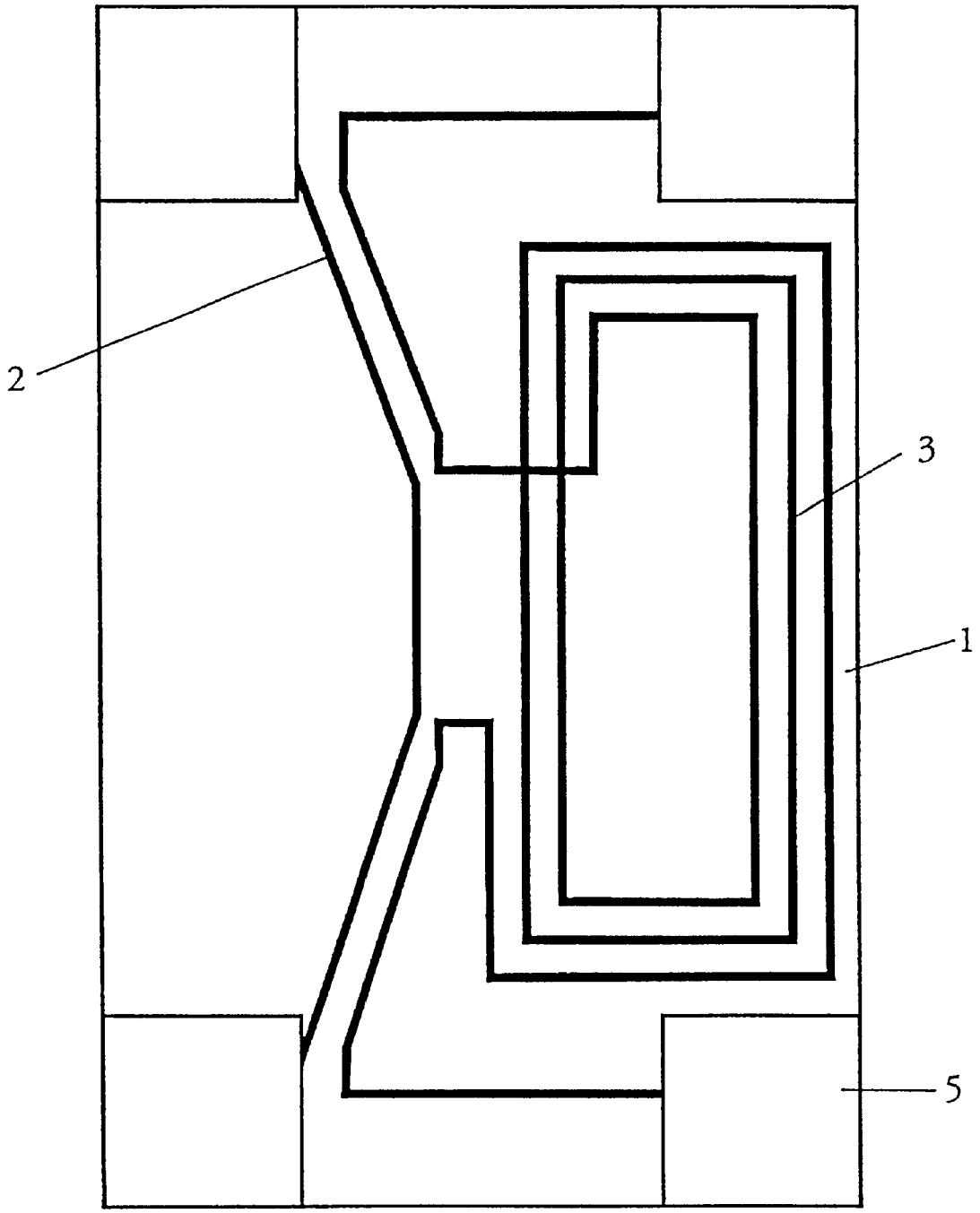
FIG. 3 is an elevation of a thin-film coupler in which a coil is integrated into the auxiliary coupler loop, FIG. 4 plots the variable parameters as a function of the frequency for a thin-film coupler in which a strip line is integrated into the auxiliary coupler loop, FIG. 5 plots the variable parameters as a function of the frequency for a thin-film coupler in which a coil is integrated into the auxiliary coupler loop, and FIG. 6 plots the variable parameters as a function of the frequency for a thin-film coupler in which a coil and a parallel-connected capacitor are integrated into the auxiliary coupler loop.

In FIG. 3, the auxiliary coupler loop 3 is provided with turns, so that it also acts as a coil on account of its shape and thus achieves a phase sift.

A protective layer of an organic and/or inorganic material may be provided over the entire thin-film coupler. The organic material used may be, for example, polybenzocyclobutene or polyimide, and the inorganic material may be, for example, $Si_3N_4$, $SiO_2$, or $Si_xO_yN_z$ ($0 \leqq x \leqq 1, 0 \leqq y \leqq 1, 0 \leqq z \leqq 1$).

Alternatively, a metal layer, for example comprising Cu, may be provided on the rear side of the carrier substrate 1. This metal layer may also be connected to at least one further current supply contact.

Embodiments of the invention will be described below, representing examples of how the invention may be realized.

Embodiment 1

A main coupler loop 2 and an auxiliary coupler loop 3 made of Cu with a width of 115 $\mu$m are provided on a carrier substrate 1 of $Al_2O_3$ with a thickness of 0.43 mm. The distance from the main coupler 2 to the auxiliary coupler loop 3 is 35 $\mu$m. The length of the coupling path between the two coupler loops is subdivided into two 1.8 mm long sections interconnected by a 20.5 mm long and 115 $\mu$m wide strip line. The strip line is the phase-shifting component 4. An SMD end contact of Cr/Cu, Cu/Ni/Sn is provided as a current supply contact 5 at each end of the two coupler loops. A metal layer of Cu is present on the lower side of the carrier substrate 1.

Figure 4:
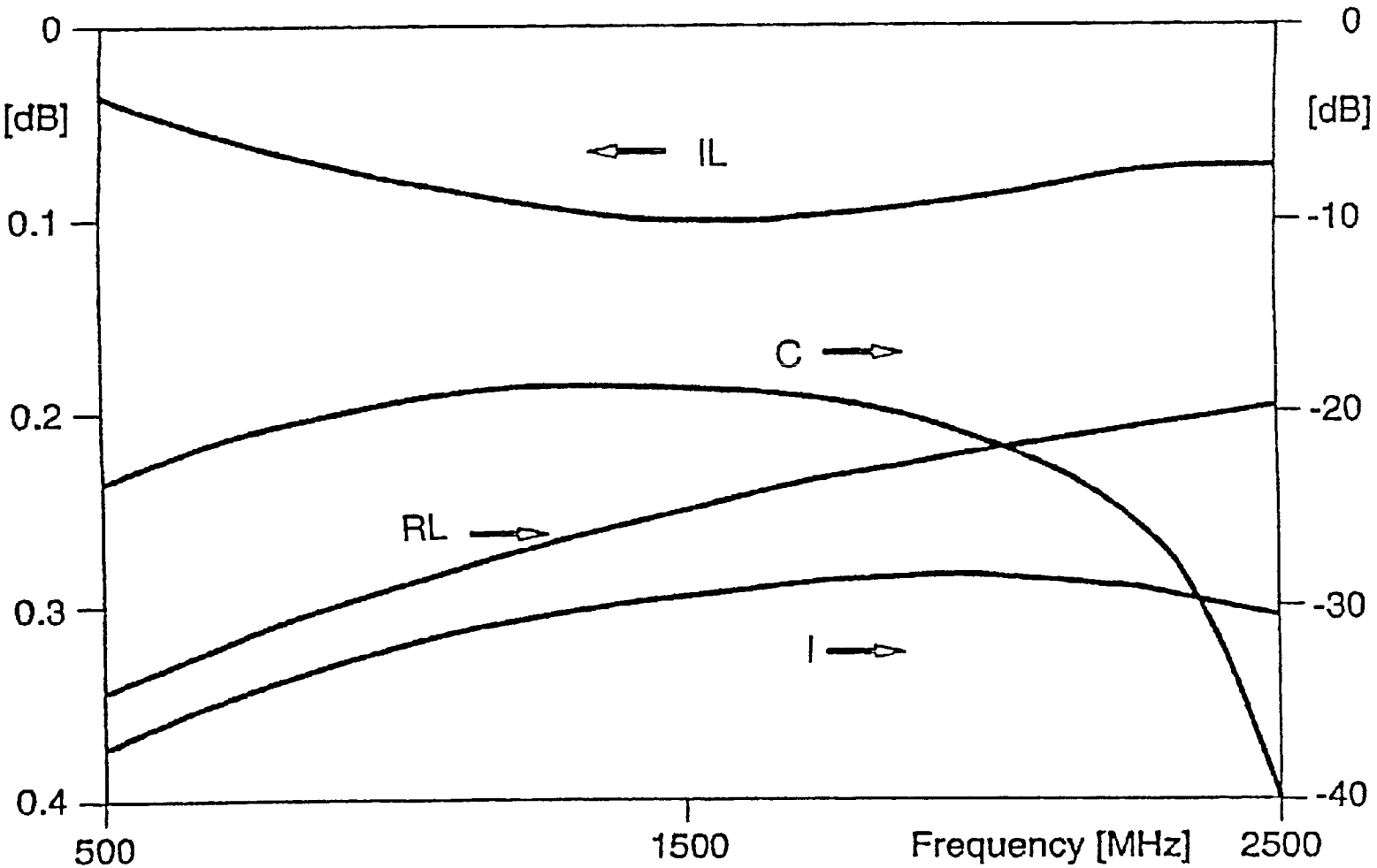

The variable parameters as a function of the frequency for this thin-film coupler are shown in FIG. 4. IL represents insertion loss, C represents coupling, RL presents return loss and I stands for isolation.

Embodiment 2

A main coupler loop 2 and an auxiliary coupler loop 3 of Cu with a width of 115 $\mu$m are provided on a carrier substrate 1 of $Al_2O_3$ with a thickness of 0.43 mm. The distance from the main coupler loop 2 to the auxiliary coupler loop 3 is 35 $\mu$m. The length of the coupling path between the two coupler loops is subdivided into two 1.45 mm long sections which are interconnected by a thin-film coil with 5.3 turns having an inner turn radius of 50 $\mu$m, a turn pitch of 20 $\mu$m, and a coil turn width of 30 $\mu$m. An SMD end contact of Cr/Cu, Cu/Ni/Sn is provided as a current supply contact 5 at each end of both coupler loops. A metal layer of Cu is present on the lower side of the carrier substrate 1.

Figure 5:
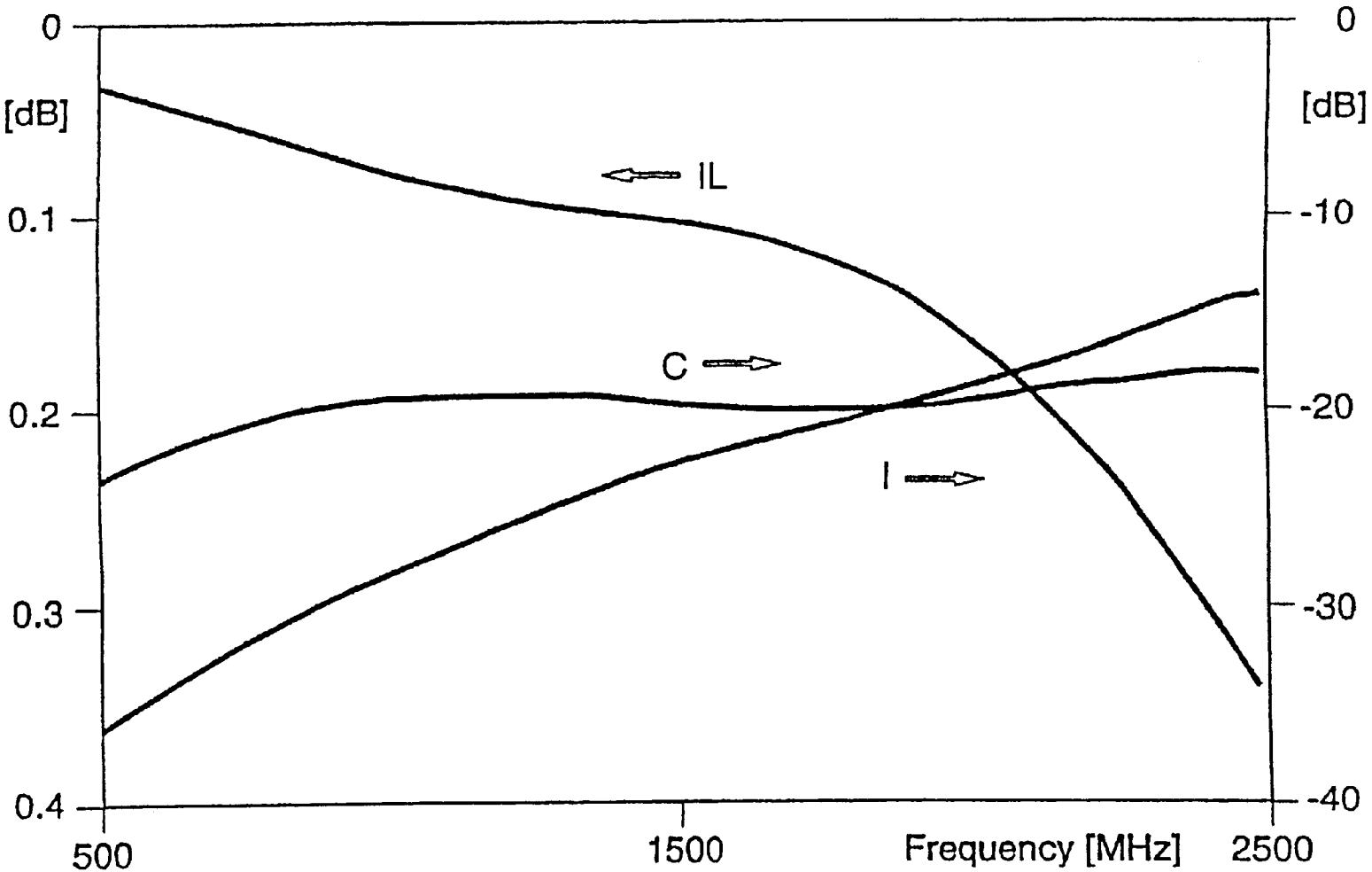

The variable parameters as a function of the frequency for this thin-film coupler are shown in FIG. 5. IL represents insertion loss, C represents coupling, and I stands for isolation.

Embodiment 3

A main coupler loop 2 and an auxiliary coupler loop 3 of Cu with a width of 115 $\mu$m are provided on a carrier substrate 1 of $Al_2O_3$ with a thickness of 0.43 mm. The distance from the main coupler loop 2 to the auxiliary coupler loop 3 is 35 $\mu$m. The length of the coupling path between the two coupler loops is subdivided into two 1.45 mm long sections which are interconnected by a thin-film coil made of Cu with an inductance value of 5.4 nH and a parallel thin-film capacitor with a capacitance value of 1 pF. The thin-film capacitor has a lower and an upper electrode of Al and a dielectric made of $Si_3N_4$. An SMD end contact made of Cr/Cu, Cu/Ni/Sn serving as a current supply contact 5 is provided at each end of both coupler loops. A metal layer made of Cu is present on the lower side of the carrier substrate 1.

Figure 6:
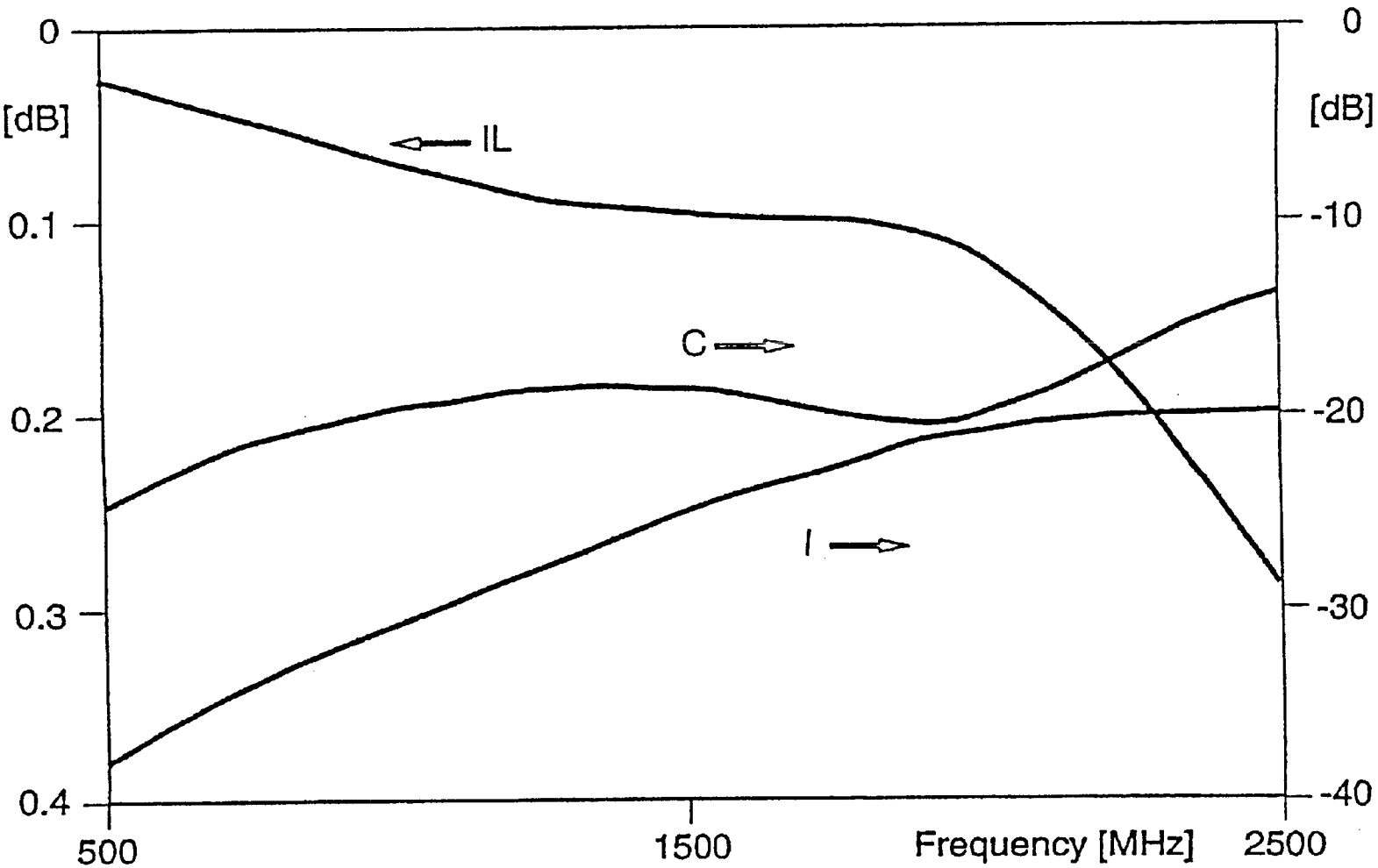

The variable parameters as a function of the frequency for this thin-film coupler are shown in FIG. 6. IL represents insertion loss, C represents coupling and I stands for isolation. It is to be understood that the numbers along the left vertical axis in FIG. 6 are insertion loss (IL) numbers and therefore represent negative gain values.

What is claimed is:

1. A thin-film wide band coupler comprising; a carrier substrate and two strip lines disposed thereon of which one is a main coupler loop and the other an auxiliary coupler loop, wherein a component is integrated into the auxiliary coupler loop, which component produces a phase shift of the frequency of the signal coupled out, wherein each end of the main coupler loop and each end of the auxiliary coupler loop are connected to a respective supply contact, and wherein the component integrated into the auxiliary loop is a coil.

2. A thin-film coupler as claimed in claim 1, characterized in that the component integrated into the auxiliary coupler loop, and producing a phase shift in the frequency of the signal coupled out via the main coupler loop, is formed by a capacitor connected in series or in parallel with said coil.

3. A thin-film coupler as claimed in claim 1, characterized in that the material comprising the carrier substrate is a ceramic material, a ceramic material with a planarizing layer of glass, a glass-ceramic material, or a glass material.

4. A thin-film coupler as claimed in claim 1, characterized in that at least one protective layer of an inorganic material and/or an organic material is provided over the thin-film coupler.

5. A thin-film wide band coupler comprising; a carrier substrate and two strip lines disposed thereon of which one is a main coupler loop and the other an auxiliary coupler loop, wherein a component is integrated into the auxiliary coupler loop, which component produces a phase shift of the frequency of the signal coupled out, wherein each end of the main coupler loop and each end of the auxiliary coupler loop are connected to a respective supply contact, and wherein the component integrated into the auxiliary loop is a coil, and characterized in that a metal layer is provided on the lower side of the carrier substrate.

6. A thin-film coupler as claimed in claim 5, characterized in that the metal layer is connected to at least one further supply contact.

7. A thin-film broadband coupler comprising;

a carrier substrate, first, second, third and fourth supply contacts disposed on the carrier substrate, a strip line main coupler loop disposed on the carrier substrate and coupled between the first and second supply contacts, a strip line auxiliary coupler loop disposed on the carrier substrate and coupled between the third and fourth supply contacts, and a phase shift component integrated into the auxiliary coupler loop and comprising a coil that provides a phase shift such as to achieve approximately a constant coupling factor over a broad frequency range.

8. The thin-film broadband coupler as claimed in claim 7 wherein said coil is a multi-turn coil.

9. The thin-film broadband coupler as claimed in claim 7 wherein the main coupler loop and the auxiliary coupler loop are disposed in close proximity to one another but without any discrete reactive coupling elements therebetween.

10. The thin-film broadband coupler as claimed in claim 7 wherein the main coupler loop and the auxiliary coupler loop are disposed in close proximity to one another but with a low electric coupling factor between at least the first and third supply contacts, and the first and second supply contacts are adapted to couple a high frequency signal between a power amplifier and an antenna.

11. The thin-film broadband coupler as claimed in claim 7 wherein the first and third supply contacts are located at corresponding first ends of the main coupler loop and the auxiliary coupler loop and the second and fourth supply contacts are located at corresponding second ends of the main coupler loop and the auxiliary coupler loop such that the first and third supply contacts and the second and fourth supply contacts are electrically separated from one another.

12. The thin-film broadband coupler as claimed in claim 7 wherein the phase shift component further comprises a capacitor integrated into the auxiliary coupler loop and connected to said coil to form an LC combination.

13. The thin-film broadband coupler as claimed in claim 7 wherein said coil is a strip line coil forming an integral element with the strip line auxiliary coupler loop.

14. The thin-film broadband coupler as claimed in claim 13 wherein said coil is chosen so as to achieve a coupling factor C as shown in FIG. 5 over the frequency range depicted in FIG. 5.

15. The thin-film broadband coupler as claimed in claim 12 wherein said coil and capacitor are chosen so as to achieve a coupling factor C as shown in FIG. 6 over the frequency range depicted in FIG. 6.

* * * * *